US008362677B1

(12) United States Patent
Morejon et al.

(10) Patent No.: US 8,362,677 B1
(45) Date of Patent: Jan. 29, 2013

(54) HIGH EFFICIENCY THERMAL MANAGEMENT SYSTEM FOR SOLID STATE LIGHTING DEVICE

(75) Inventors: Israel Morejon, Tampa, FL (US); Jinhui Zhai, Oldsmar, FL (US); Thong Bui, Tarpon Springs, FL (US); Evan O'Sullivan, Safety Harbor, FL (US); Jeremy Swiger, Tampa, FL (US)

(73) Assignee: LEDnovation, Inc., Tampa, FL (US)

( * ) Notice: Subject to any disclaimer, the term of this patent is extended or adjusted under 35 U.S.C. 154(b) by 0 days.

(21) Appl. No.: 12/768,887

(22) Filed: Apr. 28, 2010

Related U.S. Application Data

(60) Provisional application No. 61/175,116, filed on May 4, 2009.

(51) Int. Cl.
*H01K 1/58* (2006.01)
*F21V 29/00* (2006.01)

(52) U.S. Cl. ..... 313/46; 362/294; 362/373

(58) Field of Classification Search ..... 313/46; 362/294, 373

See application file for complete search history.

(56) References Cited

U.S. PATENT DOCUMENTS

2009/0161354 A1* 6/2009 Hsu et al. ..... 362/227
2010/0109499 A1* 5/2010 Vilgiate et al. ..... 313/1
2010/0164348 A1* 7/2010 Huang et al. ..... 313/46
2010/0177515 A1* 7/2010 Shoushtari ..... 362/249.02
2010/0289396 A1* 11/2010 Osawa et al. ..... 313/46
2010/0314985 A1* 12/2010 Premysler ..... 313/46

FOREIGN PATENT DOCUMENTS

WO WO 2009087897 A1 * 7/2009

* cited by examiner

*Primary Examiner* — Anh Mai
*Assistant Examiner* — Michael Santonocito
(74) *Attorney, Agent, or Firm* — Ronald E. Smith; Smith & Hopen, P.A.

(57) ABSTRACT

A high efficiency thermal management system for solid state lighting devices includes an LED heat sink housing formed by a flat bottom wall and a sidewall mounted about its periphery that extends radially outwardly so that the heat sink housing has a frusto-conical shape. Heat-dissipating pin-shaped fins of differing lengths depend from the exterior of the angled wall and from the bottom of the flat bottom wall. The radially inward side of the angled wall has a highly light-reflective surface for collimating light. The base of the device provides a housing for driver electronics. The heat sink housing, the pin-shaped fins, and the base are collectively contoured so that the system has the overall size and shape of a type A light bulb.

7 Claims, 7 Drawing Sheets

FIG. 5
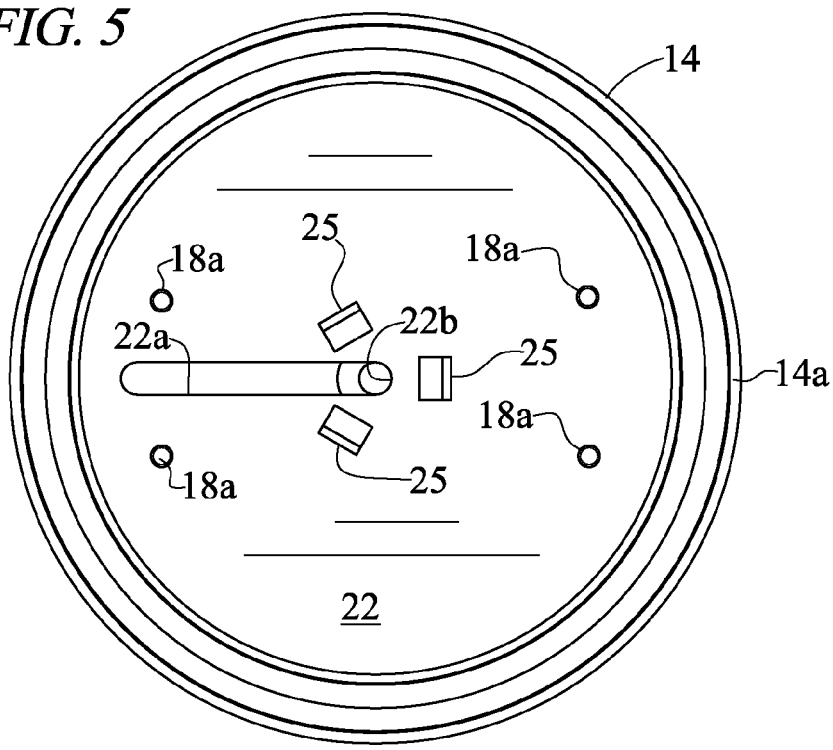
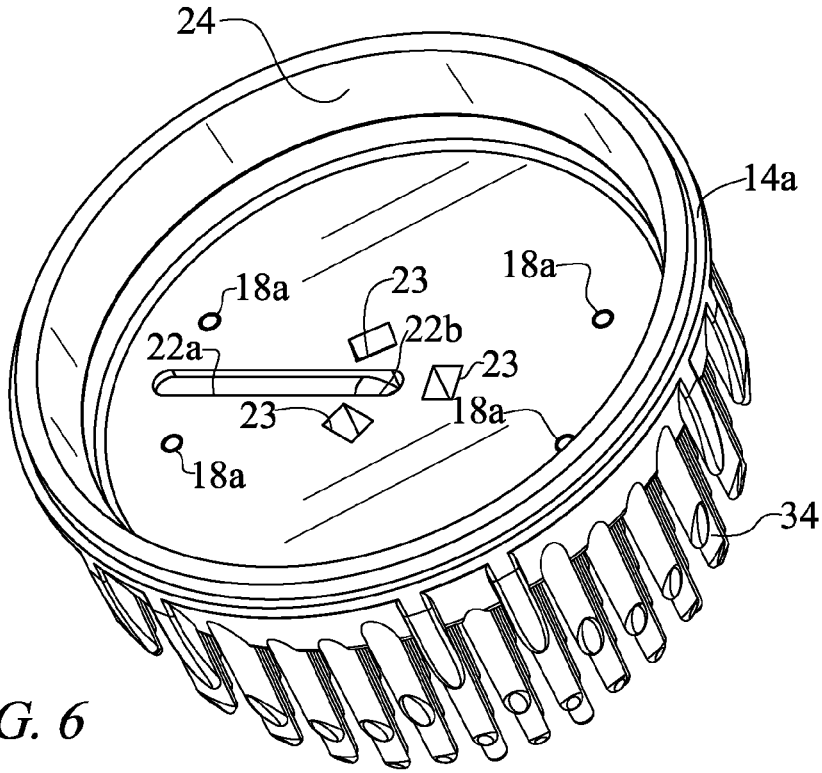
FIG. 6

HIGH EFFICIENCY THERMAL MANAGEMENT SYSTEM FOR SOLID STATE LIGHTING DEVICE

CROSS REFERENCE TO RELATED APPLICATIONS

This application is a nonprovisional of U.S. provisional patent application No. 61/175,116 filed May 4, 2009 which is hereby incorporated by reference into this disclosure.

BACKGROUND OF THE INVENTION

1. Field of the Invention

This invention relates, generally, to the art of solid state lighting devices. More particularly, it relates to a solid state lighting device having heat dissipating fins.

2. Description of the Prior Art

Conventional solid state lighting devices vary in size and shape, depending upon the type of incandescent or compact fluorescent (CFL) light bulb they are designed to replace as well as the intended location and use of the devices.

Thermal management of solid state devices is critical to performance and life of the light emitting diodes (LEDs) used in solid state lighting devices. Natural convection is most often relied on to keep the devices cool. However, with rapidly advancing LED technology, traditional heat sink housings for smaller, "A" shaped and similar bulbs are limited in the amount of heat that can be rejected.

Conventional heat sink housings typically incorporate contoured or straight fins extending radially outwardly from a longitudinal axis of symmetry of the bulb. Such fins are limited in the amount of available surface area for natural convection due to the allowable bulb envelope and the space required for driver electronics. Thermal densities of the LEDs have reached a critical point where the means of cooling must be improved.

Thus there is a need for an improved cooling means for solid state lighting devices.

There is a need as well for a solid state lighting device that fits within the envelope and replaces equivalent incandescent and CFL bulbs of various "A" type sizes such as A15, A17, A19, A21, A23, and the like.

A need also exists for a dual-purpose support structure that facilitates mounting of LEDs, diffusers, driver electronics, and a lamp base, and that provides a means of heat rejection.

However, in view of the art considered as a whole at the time the present invention was made, it was not obvious to those of ordinary skill in the art how the needed improvements could be provided.

SUMMARY OF THE INVENTION

The long-standing but heretofore unfulfilled need for an improved solid state lighting device is now met by a new, useful, and non-obvious invention.

The novel solid state lighting device includes a driver housing adapted for electrical communication with a voltage source, a heat sink, and a plurality of heat-radiating fins of differing lengths formed integrally with and depending from the heat sink. Each fin has a pin shape. The heat sink is mounted in surmounting relation to the driver housing and a diffusion dome is mounted in surmounting relation to the heat sink.

The diffusion dome, the heat sink including the plurality of fins, and the driver housing collectively have a size and shape substantially equal to a size and shape of a conventional "A" type of light bulb.

The heat sink has a frusto-conical shape defined by a flat bottom wall. An annular sidewall is mounted about the periphery of the flat bottom wall and projects upwardly and radially outwardly therefrom. The sidewall has a highly light-reflective surface on a radially inwardly facing side thereof for collimating light.

A flat printed circuit board adapted to support a plurality of light-emitting devices is secured in overlying relation to the flat bottom wall. The flat bottom wall has an elongate slot formed therein that is adapted to receive an LED cable harness. An aperture is formed in the radially innermost end of the elongate slot.

The driver housing has a top piece and a bottom piece. The top piece includes a flat, round plate having a cylindrical member mounted atop it in centered relation thereto. Means are provided for interconnecting the top piece of the driver housing to the flat bottom wall of the heat sink housing.

The bottom piece of the driver electronics housing includes a frusto-conical sidewall and a cylindrical base depending therefrom. A driver electronics printed circuit board has an upper end nested within and secured to the hollow interior of the top piece and a lower end received within and secured to a hollow interior of the bottom piece.

The primary object of the invention is to advance the art of solid state light emitting devices by providing a high efficiency solid state lighting device that incorporates a highly effective thermal management system.

A closely related object is to provide a high efficiency solid state lighting device having the shape and size of a conventional incandescent light bulb.

A more specific object is to provide a solid state lighting device having a diffusion dome, a heat sink housing, heat-dissipating fins, a driver electronics housing and a lamp base that collectively have the size and shape of a conventional incandescent light bulb.

These and other important objects, advantages, and features of the invention will become clear as this description proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which:

FIG. 5 is a top plan view of the novel heat sink;

FIG. 6 is a top perspective view of the novel heat sink;

DETAILED DESCRIPTION OF THE PREFERRED EMBODIMENT

Figure 1:
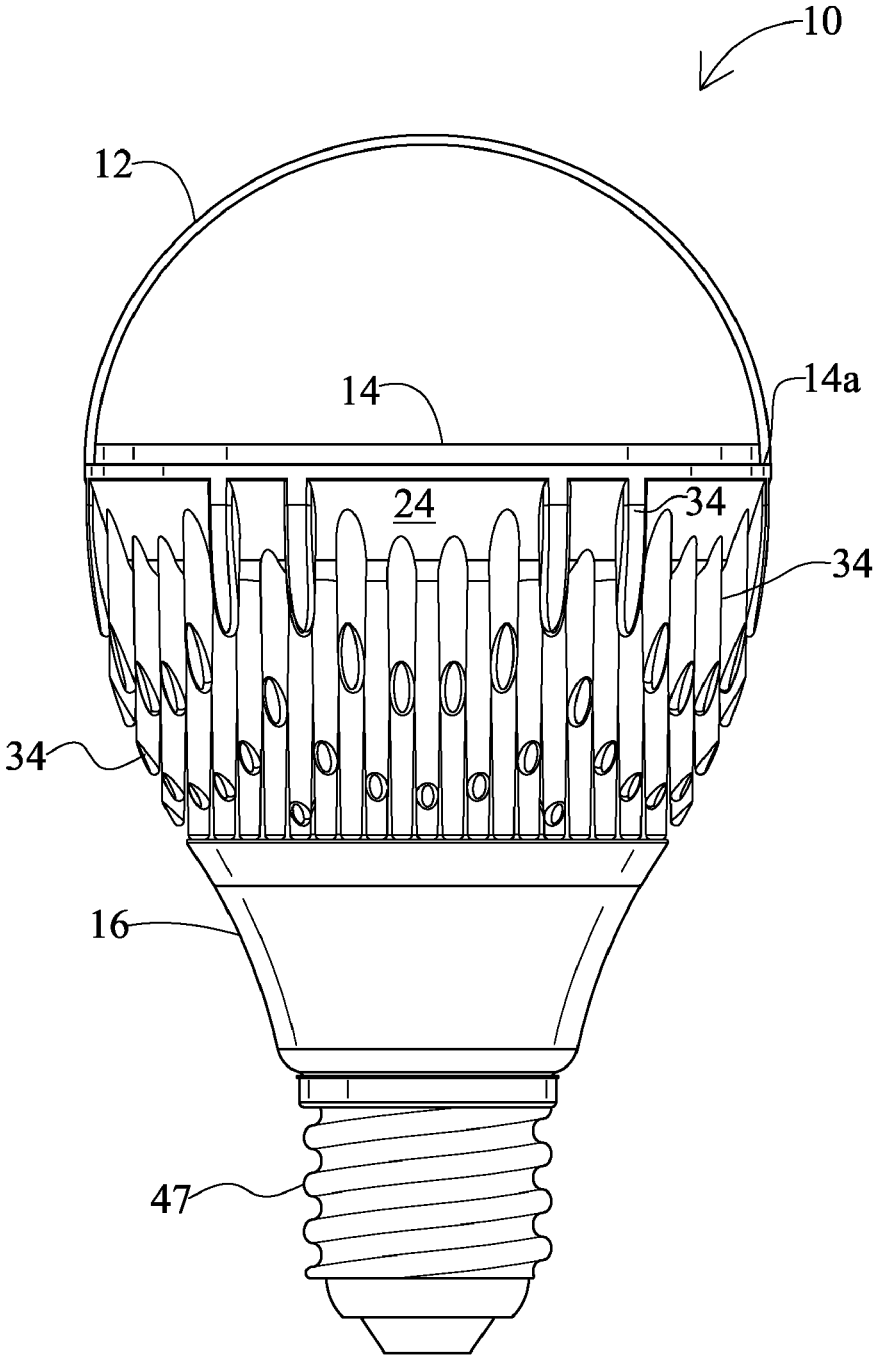
FIG. 1 is a side elevational view of a solid state lighting device that incorporates the novel thermal management system.

The novel thermal management system for a solid state lighting device is depicted in FIG. 1 as a whole by the reference numeral 10. It includes dome 12, heat sink housing 14, and driver electronics housing 16. The novel solid state lighting device is sized and shaped to replace type "A" type incandescent and compact fluorescent light (CFL) bulbs.

Figure 2:
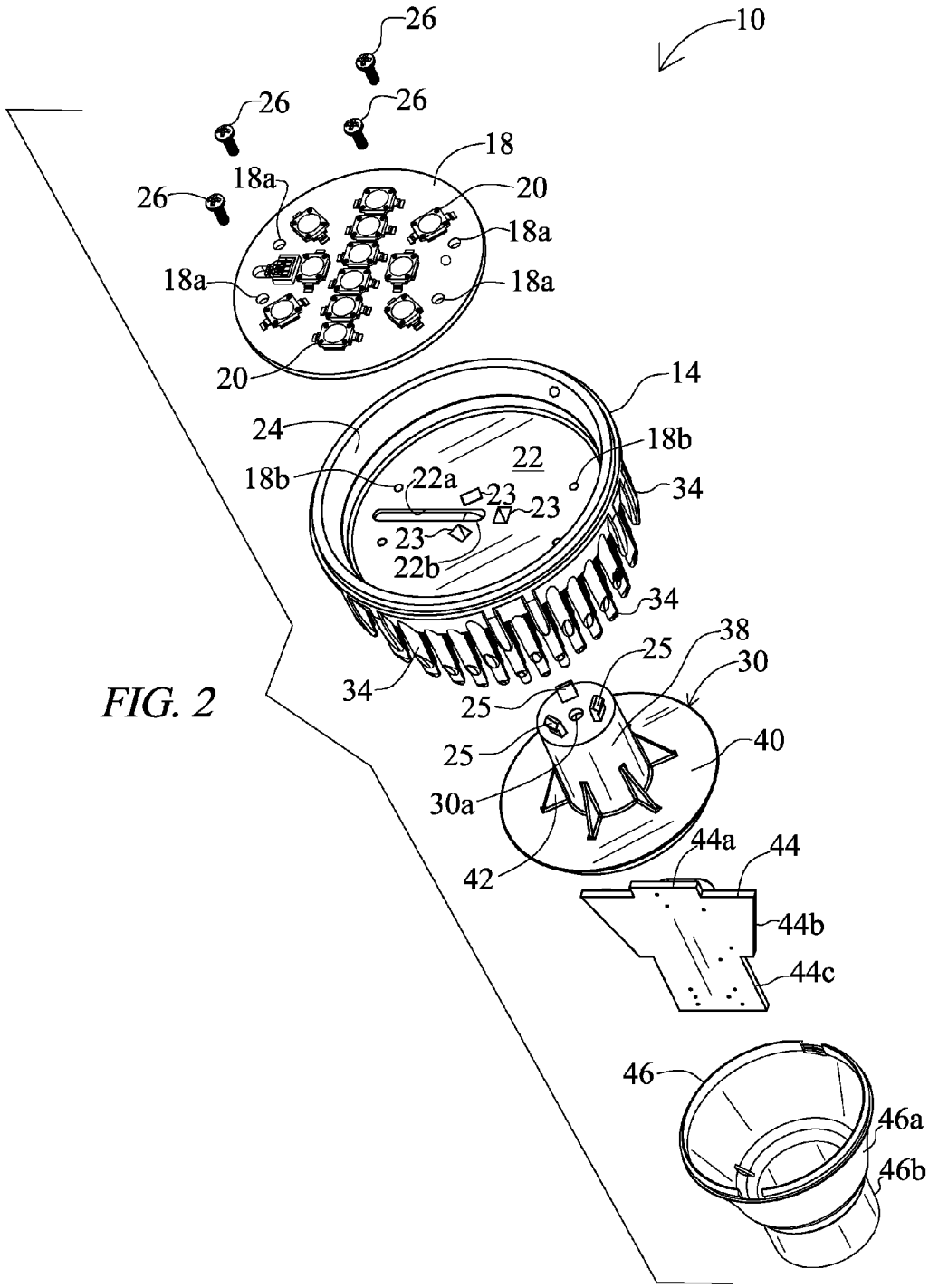
FIG. 2 is an exploded view of the novel thermal management system.

Referring now to the exploded view of FIG. 2, thermal management system 10 includes printed circuit board (PCB) 18 upon which is mounted a plurality of light emitting devices (LEDs) 20. PCB 18 is disc-shaped and overlies disc-shaped flat wall 22 when novel system 10 is fully assembled. Flat wall 22 is an integral part of heat sink housing 14 and is formed of a material having a high coefficient of heat transfer, i.e., that provides maximum heat conduction.

Annular sidewall 24 is an integral part of flat wall 22. It projects upwardly from flat wall 22 at a small radially outward angle so that heat sink housing 14 has a frusto-conical shape. The radially inward side of annular sidewall 24 is covered by a highly light-reflective surface that performs the function of collimating light before its exits device 10 through dome 12.

Elongate slot 22*a* is formed in flat wall 22, extending from the center thereof in a radially outwardly direction and having a radially outermost end disposed in closely spaced relation to annular sidewall 24. Slot 22*a* and aperture 22*b* at its radially innermost end enables routing of an LED cable harness, not depicted.

In this particular illustrative embodiment, apertures 18*a* are formed in PCB board 18 and corresponding apertures 18*b* are formed in flat wall 22 so that a plurality of fasteners such as screws 26 may be used to secure PCB board 18 in overlying relation to flat wall 22. PCB board 18 may also be press fit or otherwise secured into said overlying relation to said flat wall 22.

A third plurality of apertures 23 is also formed in flat wall 22 and encircles a longitudinal axis of symmetry of device 10. Apertures 23 receive mounting tangs 25 that surmount top piece 30 of driver housing 16 to secure said driver housing to flat wall 22 of heat sink 14. Many other suitable fastening means may be employed to securely interconnect driver electronics housing 16 to heat sink housing 14.

A suitable fastening means engages dome 12 to heat sink housing 14.

Pin fins 34, each of which has a round transverse cross-section, have differing lengths. The radially outermost pin fins 34 depend from the exterior side of frusto-conical sidewall 24. The pin fins radially inwardly of the radially outermost pin fins depend from flat wall 22. Pin fins 34 protrude to facilitate heat rejection due to natural convection. Pin fins 34 are drafted from top to bottom to facilitate manufacturing.

Figure 8:
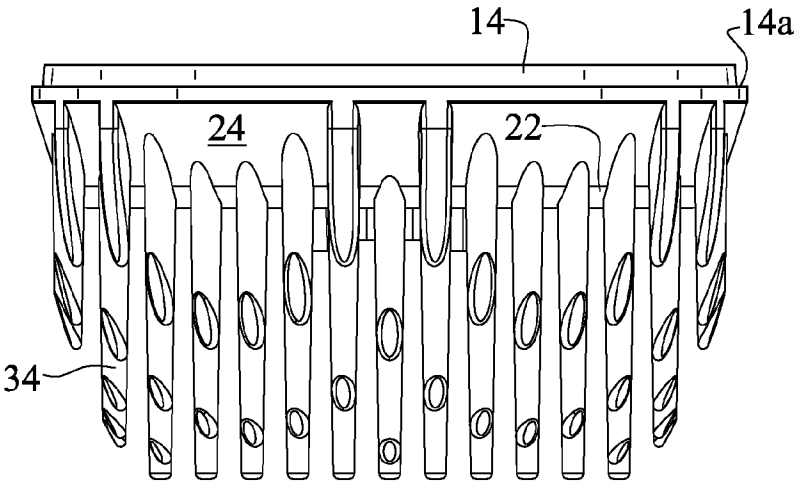
FIG. 8 is a side elevational view of the novel heat sink.
Figure 7:
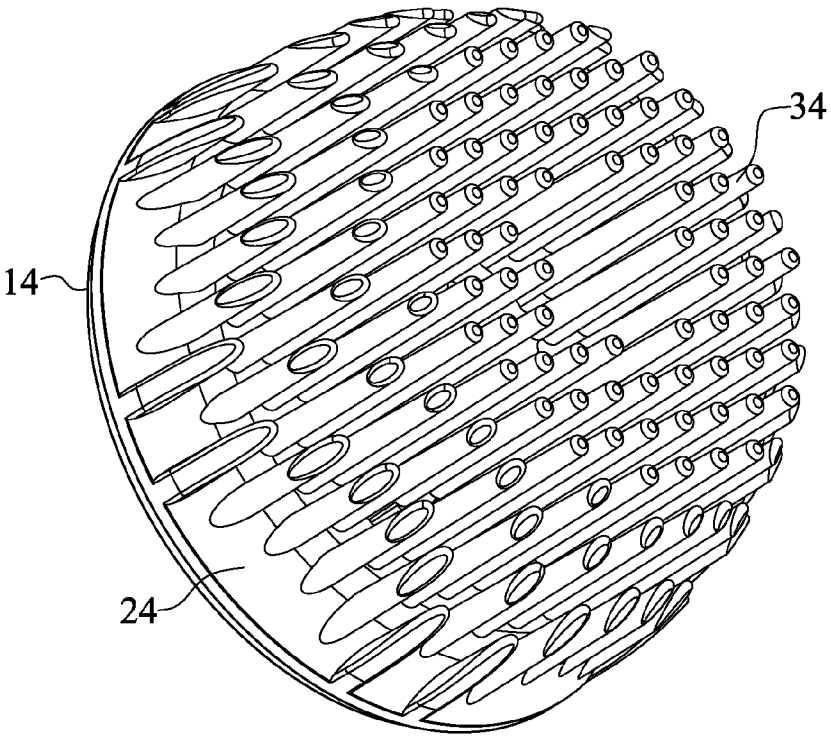
FIG. 7 is a bottom perspective view of the novel heat sink.
Figure 9:
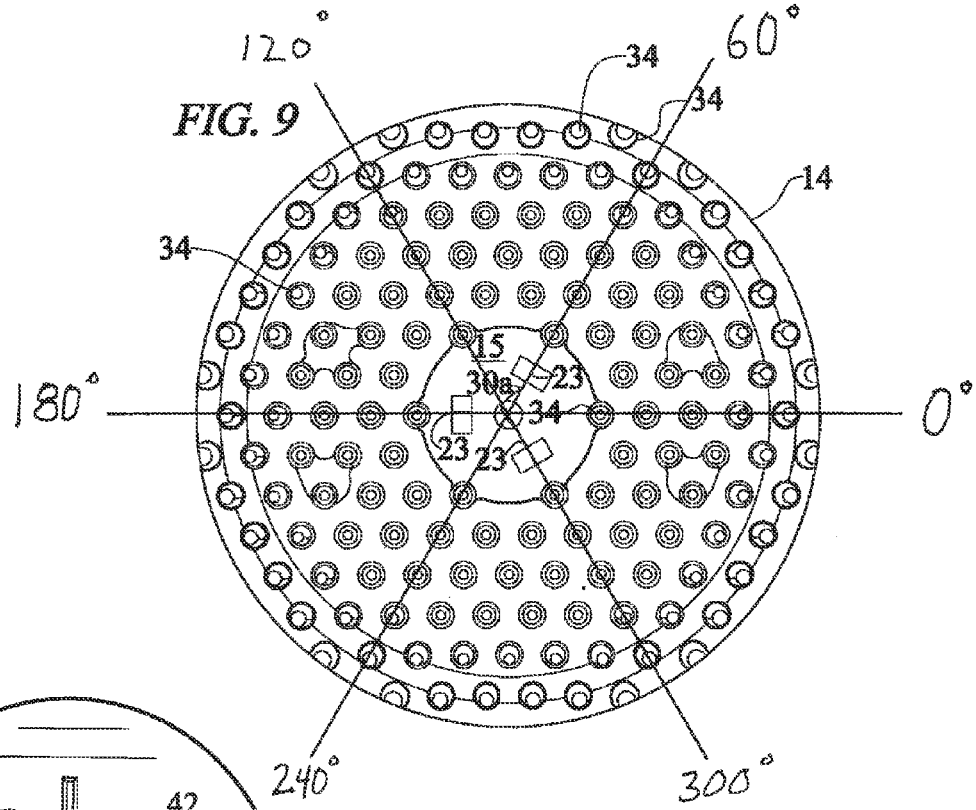
FIG. 9 is a bottom plan view of the novel heat sink.

As best depicted in FIG. 9, no pin fins are provided in center region 15 of heat sink 14 to provide space for driver electronics housing 16 and its mating connections. More particularly, mounting tangs 25 surmount top piece 30 of driver electronics housing 16 as aforesaid and pin-free center region 15 accommodates said top piece 30 so that mounting tangs 25 may engage apertures 23 as aforesaid. As depicted in FIGS. 7-9, the heat-radiating fins are individually formed and arranged in rows and columns and are parallel to one another and are equidistantly spaced apart from one another so that air freely flows in any direction including generally horizontal directions between said individual heat-radiating fins, thereby transferring heat away from heat sink 14. More particularly, as may be seen from an inspection of said Figures, cooling air may flow between said individual fins from six (6) directions at sixty degree) (60° intervals about the three hundred sixty degree (360°) circumference of the heat sink, thereby transferring heat away from said heat sink at any heat sink rotational orientation. Accordingly, heat sink 14 can be positioned in any rotational orientation and cooling air will flow between the individual fins.

Driver electronics housing 16 mates to the underside of flat wall 22 in pin fin-free region 15. The frusto-conical surface of housing 16 continues the contour formed by the pins fins that define the classic "A"-type lamp shape.

Aperture 30*a* is formed in top piece 30 in coincidence with the longitudinal axis of symmetry of system 10. It enables an undepicted LED cable harness to be electrically connected to PCB board 18.

Top piece 30 of driver electronics housing 16 includes cylindrical member 38 mounted on flat plate 40, centrally thereof. Gussets 42 are equidistantly and circumferentially spaced around cylindrical member 38 to enhance its structural integrity.

Driver electronics are mounted on upstanding PCB 44. Protuberance 44*a* is nested within the hollow interior of cylindrical member 38 when system 10 is fully assembled. PCB 44 is secured when the top and bottom pieces that form housing 16 are assembled.

Driver electronics housing 16 further includes bottom piece 46 having frusto-conical section 46*a* and cylindrical section 46*b*. A plurality of slots, not depicted, may be formed in frusto-conical section 46*a* to provide air flow inside driver electronics housing 16.

Figure 4:
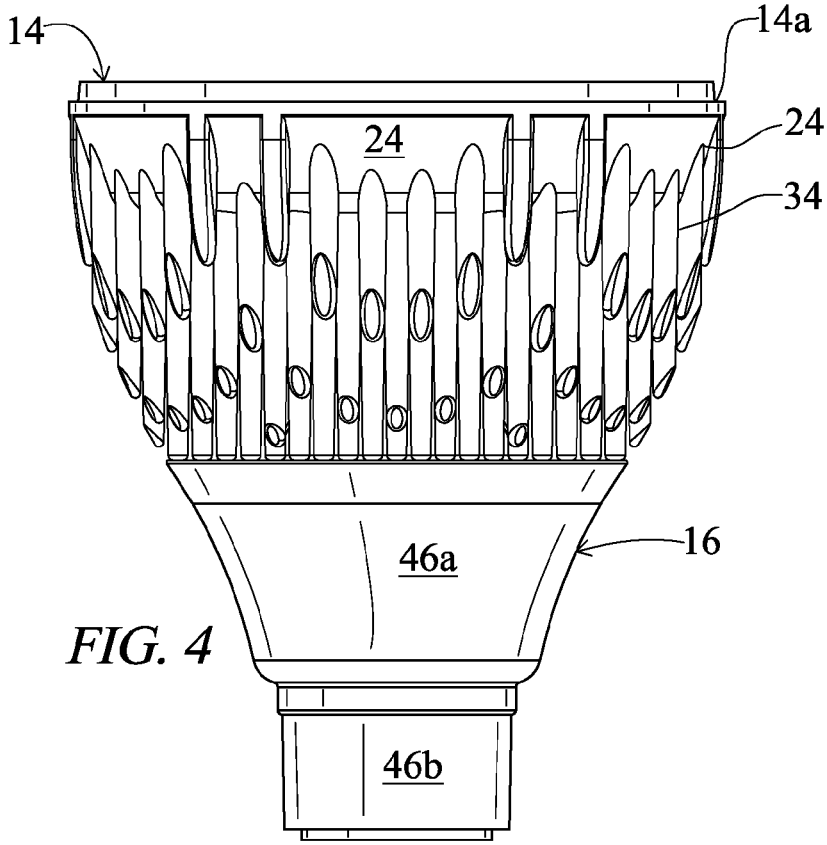
FIG. 4 is a side elevational view thereof.

As depicted in FIG. 1 and as depicted and numbered in FIG. 4, the respective contours of frusto-conical section 46*a* and cylindrical section 46*b* cooperate with the shape of pin fins 34 to produce the "A" type contour. The longest pin fins have flat bottoms that do not extend below the upper plane of frusto-conical section 46*a*. The shorter pin fins have bevels formed in their respective lowermost ends to produce said type "A" contour.

Printed circuit board 44 is flat and its upper part 44*b* has beveled edges to match the contour of frusto-conical section 46*a*. The straight lower part 44*c* of PCB 44 is received within the hollow interior of cylindrical section 46*b* as indicated in FIG. 2.

Cylindrical section 46*b* is integrally formed with frusto-conical section 46*a* and depends therefrom. It provides means for mounting the lamp base in a socket. In the embodiment of FIG. 1, a conventional Edison screw 47 is mounted on cylindrical section 46*b*.

Figure 3:
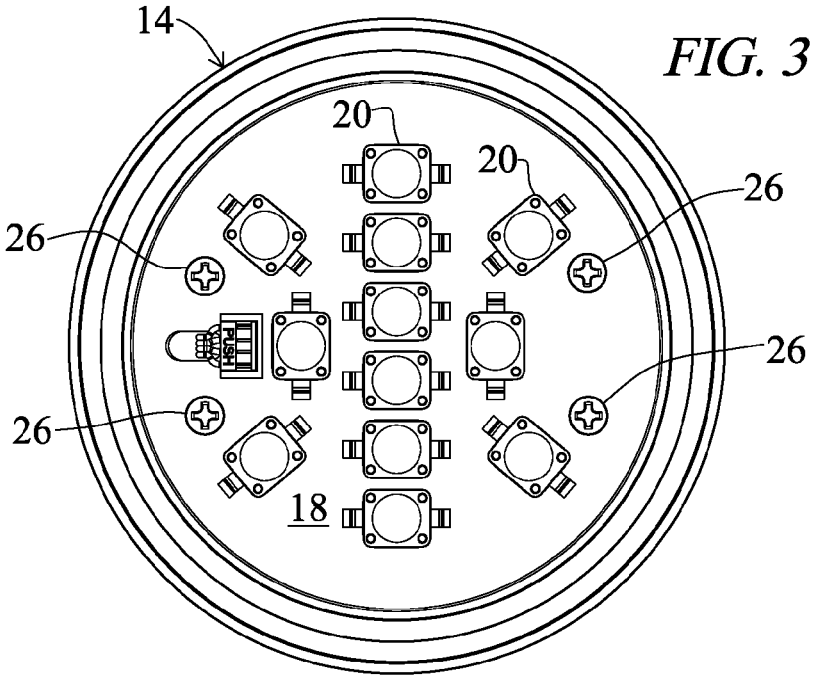
FIG. 3 is a top plan view thereof.

FIG. 3 is a top plan view depicting PCB 18 secured by screws 26 to flat wall 22 of heat sink 14.

FIG. 4 depicts how pin fins 34 are collectively sculpted to fit within the envelope of a type A lighting device.

FIG. 5 more clearly depicts aperture 22*b* at the radially innermost end of slot 22*a* formed in flat wall 22 of heat sink 14.

FIG. 6 is a top perspective view of heat sink 14. Annular ledge 14*a* provides a mount for dome 12 as perhaps best depicted in FIG. 1.

FIG. 7 is a bottom perspective view of heat sink 14, depicting how the radially outermost pin fins 34 depend from the exterior of frusto-conical sidewall 24 of heat sink and how the interior pin fins depend from the bottom of flat wall 22 of said heat sink.

The side elevational view of FIG. 8 also depicts the radially outermost pin fins 34 formed integrally with the exterior side of frusto-conical sidewall 24 and the interior pin fins depending from flat wall 22. From the bottom plan view of the novel heat sink and pin fins provided in FIG. 9, it is clear that air flow follows a path of travel that is generally normal to the longitudinal axis of each pin fin. The novel arrangement of heat-radiating fins includes a straight alignment of fins every sixty degrees (60°) about the circular perimeter of the bottom wall of the heat sink.

Figure 10:
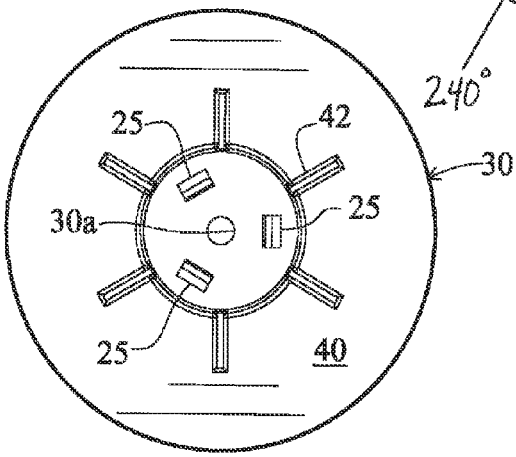
FIG. 10 is a top plan view of the novel driver housing.

Top part 30 of driver electronics housing 16 is depicted in top plan view in FIG. 10.

Figure 11:
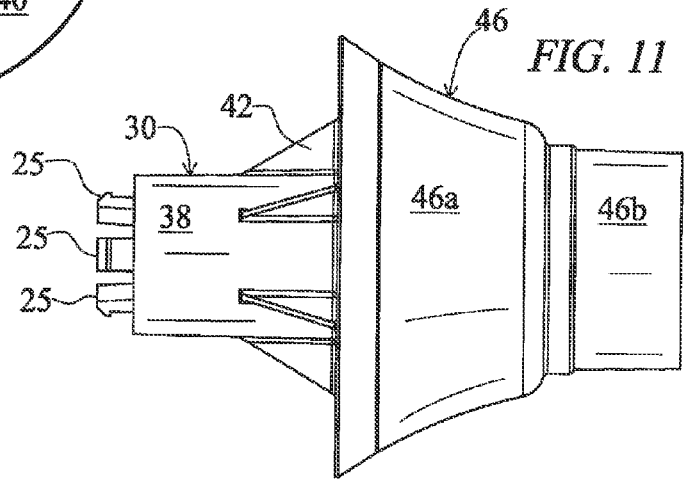
FIG. 11 is a side elevational view of the novel driver housing.
Figure 12:
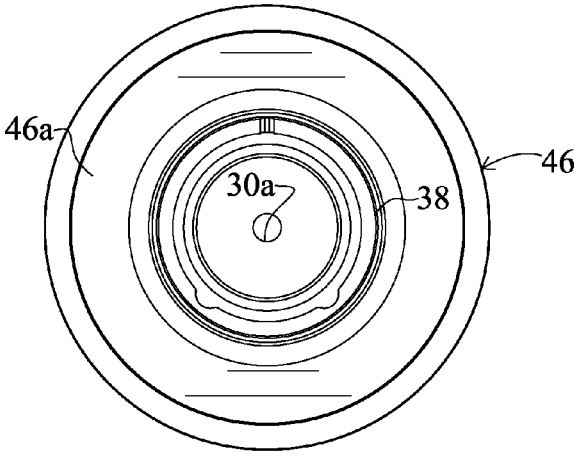
FIG. 12 is a bottom plan view of the novel driver housing.
Figure 13:
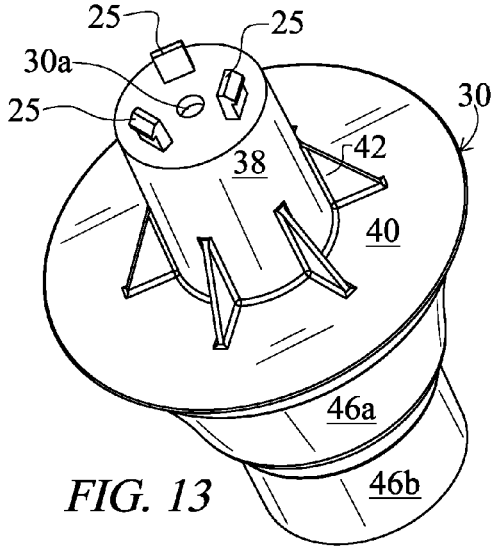
FIG. 13 is a top perspective view of the novel driver housing.
Figure 14:
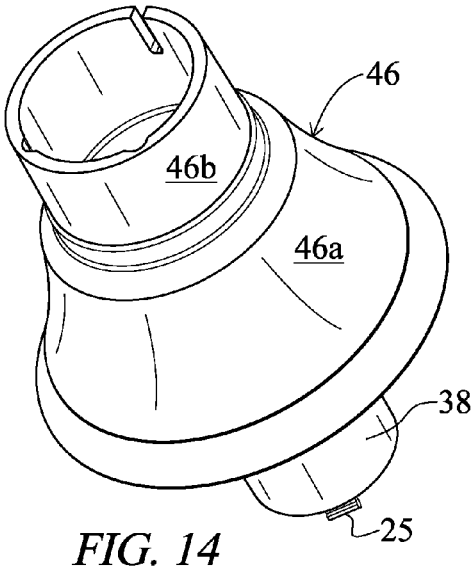
FIG. 14 is a bottom perspective view of the novel driver housing.

The fully assembled driver electronics housing 16 is depicted in side elevational view in FIG. 11, in bottom plan view in FIG. 12, in top perspective in FIG. 13 and in bottom perspective in FIG. 14.

Lighting device having novel thermal management system 10 is light in weight and provides better thermal management properties than conventional heat sink housings used in solid state lighting devices.

The novel heat sink has an increased surface area for convection cooling and provides nearly equal space for driver electronics. It also provides a continuous thermal interface for PCB 18 and includes integrated reflector surface on the radially inward side of angled annular sidewall 24 for collimating light output as aforesaid.

System 10 includes means for holding and retaining all components of a working solid state lighting bulb optimized for natural convection and the equivalent lumen output of a twenty-five to one hundred watt (25-100 W) incandescent bulb. The novel solid state lighting device meets the envelope constraints of ANSI C78-20 for "A" style bulbs in the particular sizes and wattages contained therein.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A solid state lighting device, comprising:

a driver housing adapted for electrical communication with a voltage source;

a heat sink having a frusto-conical shape defined by a flat, disc-shaped bottom wall having a circular perimeter and an annular sidewall mounted about the circular perimeter of said flat, disc-shaped bottom wall and projecting upwardly and radially outwardly therefrom;

a plurality of individual heat-radiating fins of differing lengths formed integrally with and depending from said disc-shaped bottom wall of said heat sink;

each fin of said plurality of individual heat-radiating fins having a straight configuration in the form of a pin so that ambient air surrounds each pin and is free to flow between contiguous pins;

said heat sink mounted in surmounting relation to said driver housing;

a diffusion dome mounted in surmounting relation to said heat sink;

said heat sink including said plurality of individual heat-radiating fins, and said driver housing collectively having a size and shape substantially equal to a size and shape of a conventional class "A" type of light bulb;

said class "A" type of light bulb having a longitudinal axis of symmetry;

said disc-shaped bottom wall of said heat sink being disposed normal to said longitudinal axis of symmetry;

each fin of said plurality of heat-radiating fins having a longitudinal axis of symmetry parallel to said longitudinal axis of symmetry of said class "A" type of light bulb;

each fin of said plurality of individual heat-radiating fins being uncovered and surrounded by ambient air;

said plurality of individual heat-radiating fins arranged in rows and columns and being parallel to one another and being equidistantly spaced apart from one another so that air may flow in multiple directions between said heat-radiating fins, thereby transferring heat away from said heat sink, said multiple directions including air flow about a three hundred sixty degree (360°) circumference of said flat, disc-shaped bottom wall of said heat sink, thereby transferring heat away from said heat sink at any rotational orientation of said heat sink;

said air flow being generally normal to the longitudinal axis of symmetry of each fin of said plurality of heat-radiating fins; and said arrangement of heat-radiating fins including a straight alignment of fins every sixty degrees about the circular perimeter of said heat sink.

2. The solid state lighting device of claim 1, further comprising:

said annular sidewall having a light-reflective surface on a radially inwardly facing side thereof for collimating light.

3. The solid state lighting device of claim 2, further comprising:

a flat printed circuit board adapted to support a plurality of light-emitting devices;

said flat printed circuit board being secured in overlying relation to said flat, disc-shaped bottom wall of said heat sink.

4. The solid state lighting device of claim 3, further comprising:

said flat, disc-shaped bottom wall of said heat sink having an elongate slot formed therein, said elongate slot adapted to receive an LED cable harness; and an aperture formed in said flat, disc-shaped bottom wall at a radially innermost end of said elongate slot.

5. The solid state lighting device of claim 3, further comprising:

said driver housing having a top piece and a bottom piece;

said top piece including a flat, round plate and a cylindrical member mounted atop said flat, round plate in centered relation thereto; and means for interconnecting said top piece of said driver housing to said flat, disc-shaped bottom wall of said heat sink.

6. The solid state lighting device of claim 5, further comprising:

said means for interconnecting said top piece of said driver housing to said flat, disc-shaped bottom wall of said heat sink being a plurality of apertures formed in said flat, disc-shaped bottom wall in encircling relation to a center of said flat, disc-shaped bottom wall and a plurality of mating tangs formed in a top wall of said top piece of said driver housing.

7. The solid state lighting device of claim 5, further comprising:

said bottom piece including a frusto-conical sidewall and a cylindrical base depending from said frusto-conical sidewall;

a driver electronics printed circuit board having an upper end secured to said top piece and having a lower end received within a hollow interior of said bottom piece.

* * * * *